US007001090B2

(12) United States Patent
Liu et al.

(10) Patent No.: US 7,001,090 B2
(45) Date of Patent: Feb. 21, 2006

(54) OFFSET PEN

(76) Inventors: Bao-Shen Liu, 1F., No. 65-1, Lane 3, Sec. 2, Daguan Rd., Banciao City, Taipei County (TW); Chang-Yun Yong, 1F., No. 65-1, Lane 3, Sec. 2, Daguan Rd., Banciao City, Taipei County (TW)

( * ) Notice: Subject to any disclaimer, the term of this patent is extended or adjusted under 35 U.S.C. 154(b) by 23 days.

(21) Appl. No.: 10/755,304

(22) Filed: Jan. 13, 2004

(65) Prior Publication Data

US 2005/0152736 A1 Jul. 14, 2005

(51) Int. Cl.
*A46B 5/02* (2006.01)
*B43K 21/02* (2006.01)
*B43K 21/14* (2006.01)

(52) U.S. Cl. ..... 401/6; 401/56; 401/57

(58) Field of Classification Search ..... 401/6, 401/88, 195, 52, 56, 57; 16/430
See application file for complete search history.

(56) References Cited

U.S. PATENT DOCUMENTS 655,731 A * 8/1900 Pierce ..... 401/230
2,265,329 A 12/1941 Wachs
3,342,182 A 9/1967 Charos
3,596,798 A 8/1971 Smith
3,608,708 A 9/1971 Storandt
3,898,009 A * 8/1975 Christensen ..... 401/57
4,030,841 A * 6/1977 Balasty ..... 401/6
4,034,853 A 7/1977 Smith
4,122,554 A 10/1978 Stager
4,167,347 A * 9/1979 Hoyle ..... 401/88
4,185,330 A 1/1980 Stager
4,186,445 A 2/1980 Stager
4,645,251 A 2/1987 Jacobs
4,677,697 A 7/1987 Hayes
4,768,818 A 9/1988 Kolic
4,788,733 A 12/1988 Lerner
4,845,781 A 7/1989 Strickland et al.
4,902,283 A 2/1990 Rojko et al.
4,928,322 A 5/1990 Bradfield
4,937,881 A 7/1990 Heise (Continued)

FOREIGN PATENT DOCUMENTS

DE 10040210 9/2001

(Continued)

*Primary Examiner*—David J. Walczak
(74) *Attorney, Agent, or Firm*—Rosenberg, Klein & Lee

(57) ABSTRACT

A offset pen includes a holding part, a writing end and a connecting part connected therebetween, in which the writing end and the holding part are disposed on different axes. When the user is operating the writing tool, the holding part inclines naturally while the writing end keeps vertical to the writing surface, and the writing result can be observed through the visible space formed between the writing end and the holding part. A holding end is disposed at the front end of the holding part of the writing tool, and each surface of the holding end can be twisted into irregular surfaces. Since the holding part, the connecting part and the writing end are substantially arranged as a Z letter, a perfect fitting feeling of the fingers can be created. Therefore, different users can feel comfortable and the fingers of the users with different holding poses can be naturally directed to a correct holding position, so as to form various geometric states suitable for hand holding. In addition, the holding part includes a receiving space for receiving the refills for substituting.

9 Claims, 10 Drawing Sheets

U.S. PATENT DOCUMENTS

| | | | | |
|---|---|---|---|---|
| 4,959,881 | A | | 10/1990 | Murray |
| 4,980,943 | A | | 1/1991 | Barber |
| 5,003,638 | A | | 4/1991 | Miyake et al. |
| 5,020,159 | A | | 6/1991 | Hellickson |
| 5,089,205 | A | | 2/1992 | Huang et al. |
| 5,186,322 | A | | 2/1993 | Harreld et al. |
| 5,301,806 | A | | 4/1994 | Olson |
| 5,335,373 | A | | 8/1994 | Dresdner et al. |
| 5,357,636 | A | | 10/1994 | Dresdner, Jr. et al. |
| 5,438,708 | A | | 8/1995 | Jacovitz |
| 5,527,124 | A | * | 6/1996 | Kolaric ..... 401/6 |
| 5,679,399 | A | | 10/1997 | Shlenker et al. |
| 5,704,670 | A | | 1/1998 | Surplus |
| 5,767,163 | A | | 6/1998 | Kundsin |
| 5,806,668 | A | | 9/1998 | Bixby |
| 5,864,883 | A | | 2/1999 | Reo |
| 5,956,770 | A | | 9/1999 | Dennis |
| 5,961,167 | A | | 10/1999 | Gilley |
| 5,965,276 | A | | 10/1999 | Shlenker et al. |
| 5,987,645 | A | | 11/1999 | Teaster |
| 6,116,668 | A | | 9/2000 | Carpol |
| 6,168,019 | B1 | | 1/2001 | Olson |
| 6,250,828 | B1 | * | 6/2001 | Liu ..... 401/6 |
| D446,368 | S | | 8/2001 | Pizarro |
| 6,385,806 | B1 | | 5/2002 | Katakura et al. |
| 6,393,614 | B1 | | 5/2002 | Eichelbaum |
| 6,398,443 | B1 | | 6/2002 | Barela |
| 6,423,328 | B1 | | 7/2002 | Chou |
| 6,481,766 | B1 | | 11/2002 | May et al. |
| 6,511,111 | B1 | | 1/2003 | Dooley |
| 6,513,998 | B1 | | 2/2003 | Barry |
| 2002/0055312 | A1 | | 5/2002 | Beraznik |
| 2002/0116746 | A1 | | 8/2002 | Williams |
| 2002/0177828 | A1 | | 11/2002 | Batich et al. |
| 2002/0178482 | A1 | | 12/2002 | Samuelsson et al. |

FOREIGN PATENT DOCUMENTS

| | | |
|---|---|---|
| FR | 2 694 877 | 2/1994 |
| FR | 2 702 947 | 9/1994 |
| FR | 2 813 777 | 3/2002 |
| GB | 2 061 709 | 5/1981 |
| GB | 2 113 977 | 8/1983 |
| GB | 2 231 027 | 11/1990 |
| JP | 6136603 | 5/1994 |
| JP | 7213474 | 8/1995 |
| JP | 8206049 | 8/1996 |
| JP | 11012820 | 1/1999 |
| JP | 2001187011 | 7/2001 |
| WO | WO 96 10356 | 4/1996 |
| WO | WO 03 030701 | 4/2003 |

* cited by examiner

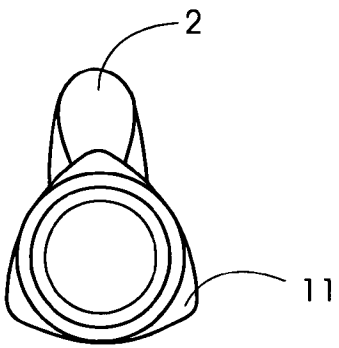
FIG.2B
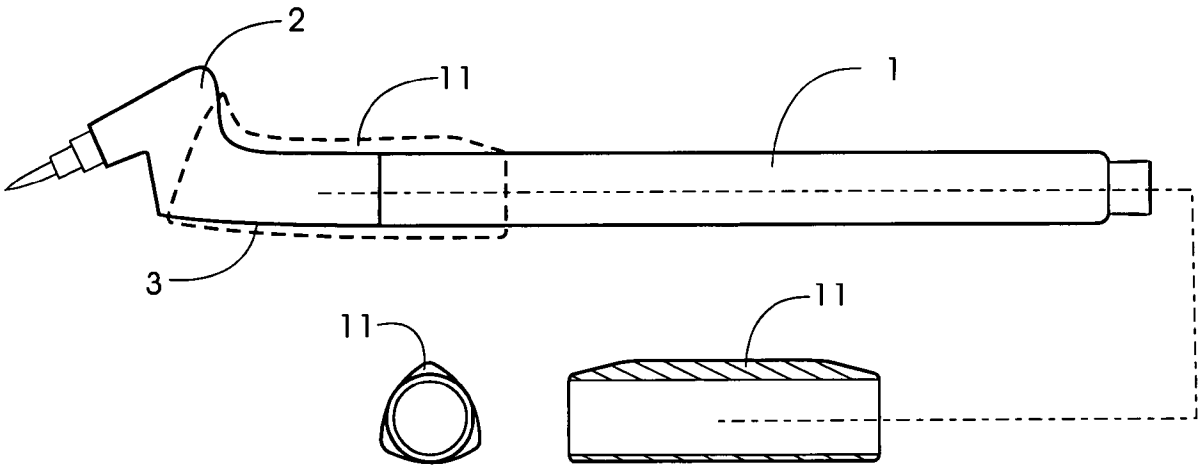
FIG.2
FIG.2A

OFFSET PEN

FIELD OF THE INVENTION

The present invention relates to an improved structure of a different axial pen, and particularly to a writing tool which is improved from the "OFFSET PEN" of U.S. Pat. No. 6,250,818 and can overcome the disadvantage of the difficulty of seeing the writing position. The writing tool has a holding part structure, which lets the user have a holding pose for naturally positioning and keep a good writing habit to ensure smooth writing and neat written characters. The writing tool can also increase the comfort of the fingers operating the different axial pen, and is more easily operated.

BACKGROUND OF THE INVENTION

For a long time, all the common writing tool, such as a pencil, a colored pencil, a pen, a rollerball pen or a writing brush, belongs to a linear design, i.e. the writing end and the holding part are designed on the same axis. Due to the structure limit of the human hand, the holding part would be inclined rearward, which results in an inclined angle between the writing end and the working surface. Also, the writing surface would be sheltered by the hand and the writing end of the writing tool, so that the writer cannot clearly monitor the writing contents in time or control the precision.

Therefore, for monitoring the writing contents, the writer has to adjust his pose all the time upon operating, even adopt an improper holding manner, so it is hard to develop a good writing habit, and it causes bad influences on the hand and the vision. Especially for those kids whose hands and control functions are not well developed yet, the conventional linear writing tool almost cannot let the kids operate smoothly.

Because of the above-described disadvantages generated from the conventional writing tool, the applicant keeps on carving unflaggingly to develop a new offset pen of the present invention through wholehearted experience and research.

To overcome the above-mentioned problems, the Inventor provides a solution for the "OFFSET PEN" of U.S. Pat. No. 6,250,818, i.e. changing the connecting manner of the writing tool, so that the holding part and the writing end are arranged at different axes. As a result, the user can maintain the original writing pose, but the writing view would not be sheltered, so as to keep stable writing works and reduce the loading of the writer.

However, although the aforesaid different axial pen is substantially designed as a Z letter to overcome the problem of unclear writing view and prevent the fingers from sliding to the writing surface upon writing, the writer still has to hold the pen according to the modeling of the pen when using the different axial pen. Hence, it is a first object of the present invention to provide a offset pen, in which the holding part can be adjusted according to the writer's writing habit, the lengths of the finger and the thicknesses; and improve the different axial pen to achieve a better use, so that the writer can hold and operate the writing tool more naturally and comfortably.

SUMMARY OF THE INVENTION

It is an object of the present invention to provide a offset pen, in which the writing end and the holding part of the writing tool are not arranged at the same axis, but substantially arranged as a Z letter. The holding end has a positioning effect, which lets the user get a concerted holding action and develop a natural and correct writing habit.

It is a second object of the present invention to provide a offset pen which is adjustable to be cooperated with the holding pose of the user. The writing tool of the present invention is substantially configured as a Z letter, and the holding end can be deflected and result in irregular surfaces, so as to create perfect fitting feeling of the fingers. In addition, since the structure can be adjusted into variable geometric holding states, different users can get respective comfortable holding poses therefrom, in which their fingers can be naturally directed to the correct holding position and keep the user's operation in the best condition.

It is a third object of the present invention to provide a offset pen in which the writing end maybe used in combination with a ballpoint pen, a rollerball pen or a pencil, etc.

It is a fourth object of the present invention to provide a offset pen in which the refill can be various types according to the needs, such as the pencil, a colored pencil, a charcoal pencil, a crayon and a chalk, a rubber, water-based fibers, water-based animal hairs, water-based chemical hairs, water-based plastic compounds, and water-based, oil-based or powder-based solid, and the refills for substituting are contained in the receiving space of the holding part.

It is a fifth object of the present invention to provide a offset pen in which a visible space is formed between the writing end and the holding part. The visible space provides an observing region so that the user can monitor the writing condition and keep a good writing pose.

It is a sixth object of the present invention to provide a offset pen in which a fixing pillar is disposed in the writing end to prevent the backing of the refill. The length of the fixing pillar can be adjusted according to the type of the refill to facilitate the positioning of the refill.

It is a seventh object of the present invention to provide a offset pen having an adjustable holding end structure, in which the holding end can be twisted according to the user's holding pose to obtain the most optimal holding pose.

It is an eighth object of the present invention to provide a offset pen in which the different axial angle of the writing end with respect to the holding part can be adjusted to obtain the most optimal holding pose.

BRIEF DESCRIPTION OF THE DRAWINGS

The present invention may best be understood through the following description with reference to the accompanying drawings, in which:

FIG. 2 shows an illustrative view of the appearance of the writing tool according to the present invention, in which the holding end is put around the holding part externally;

FIG. 2A shows an illustrative view of holding end of FIG. 2;

FIG. 2B shows an illustrative view of the structural end of FIG. 2;

DETAILED DESCRIPTION OF THE PREFERRED EMBODIMENT

Figure 1:
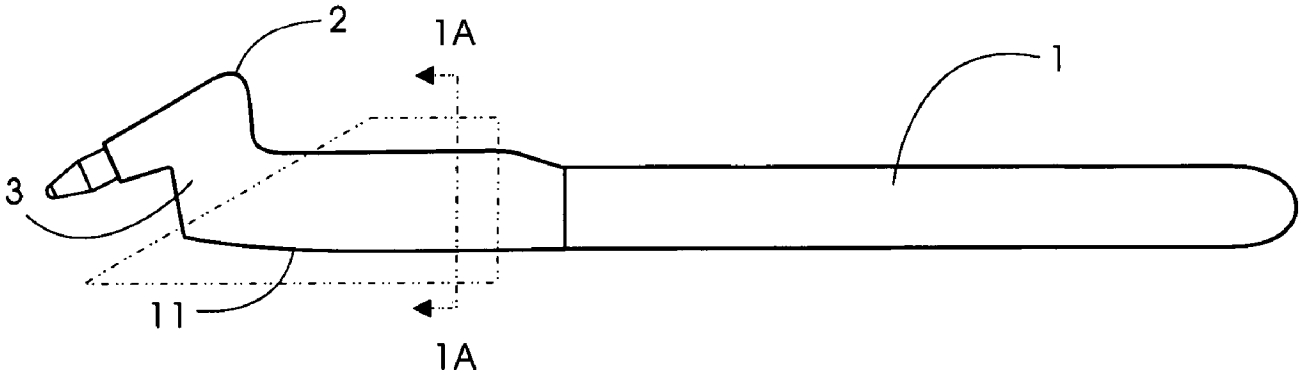
FIG. 1 shows an illustrative view of the appearance of the writing tool according to the present invention.
Figure 1A:
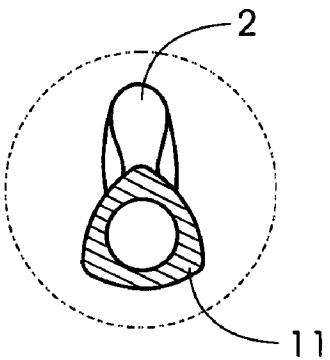
FIG. 1A shows an illustrative view of the structural end of FIG. 1.

Please refer to FIGS. 1 and 1A. The offset pen provided by the present invention mainly includes a holding part 1 and a writing end 2 disposed on the front end of the holding part 1, so that the writing end 2 and the holding part 1 are disposed on different axes. The offset pen further includes a connecting part 3 connected between the holding part 1 and the writing end 2, and the holding part 1, the writing end 2 and the connecting part 3 are substantially arranged as a Z letter. A holding end 11 is disposed on the front end of the holding part 1 close to the connecting part 3. The cross-section of the holding end 11 is a triangle, which is suitable to be held for the user. Therefore, when the user operates the offset pen of the present invention, his hand would be directed to a correct position on the holding end 11, so as to avoid improper holding pose, ensure holding on the correct position each time, and develop a good holding habit.

Please refer to FIGS. 2 and 2B. The holding end 11 is put around the holding part 1 externally. For example, a triangular plastic sleeve as a holding end 11 is put around the front end of the holding part 1 to enhance the purpose of adjusting the holding pose of the user.

Figure 3:
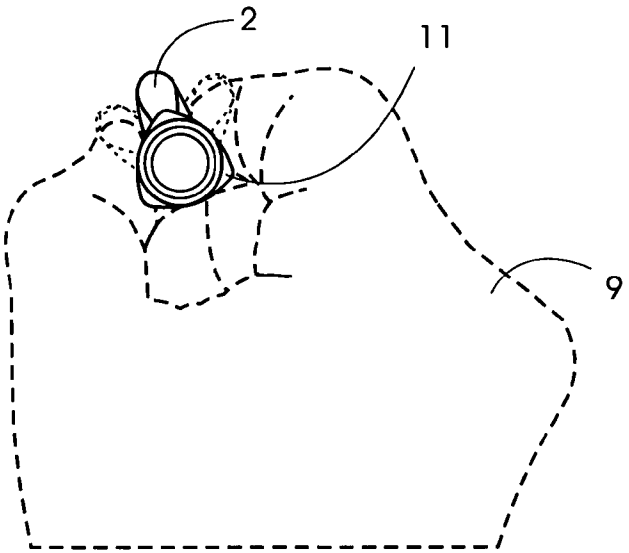
FIG. 3 shows the variation of the holding direction according to the present invention.
Figure 3A:
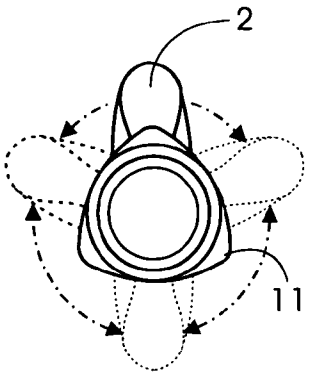
FIG. 3A shows an illustrative view of a certain holding direction.
Figure 3B:
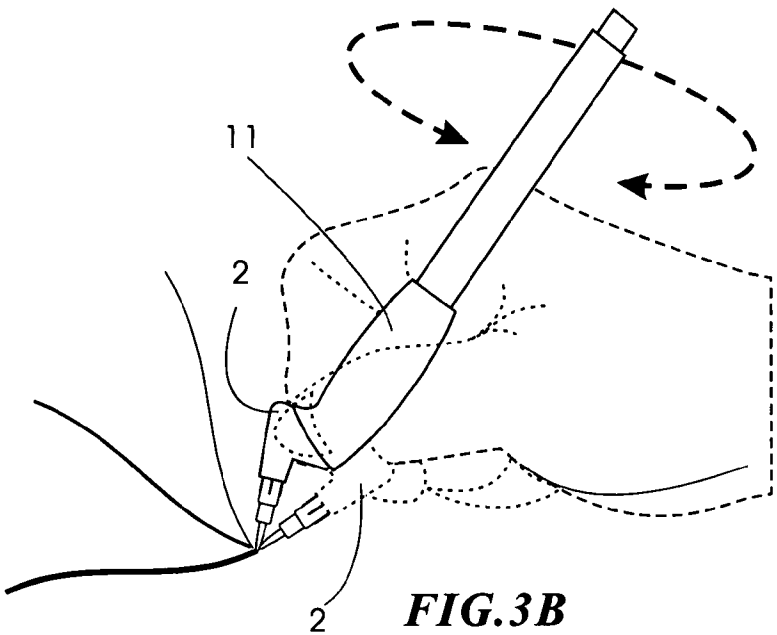
FIG. 3B shows an illustrative view of the variation of the writing view and the writing line.

Please refer to FIGS. 3, 3A and 3B. The holding end 11 is substantially a triangle. Due to the triangular holding end 11 accompanying with the Z letter offset pen of the present invention, a best holding pose, which conforms to the nature most, can be formed. In addition, the holding end 11 can be rotated, which results in different angles of the writing end 2, as shown in FIG. 3A. Therefore, rotating the holding end 11 can not only keep the comfortable holding pose, but also create an adjustable writing view and obtain a thickness change of the writing line, as shown in FIG. 3B. Moreover, each end surface of the holding end 11 can further include skidproof patterns to enhance the holding effect. Furthermore, the holding end 11 can be changed to the form of other geometric polygon, as long as the holding surface of the geometric polygon is adjusted to be suitable for naturally holding of the hand 9.

Figure 4A:
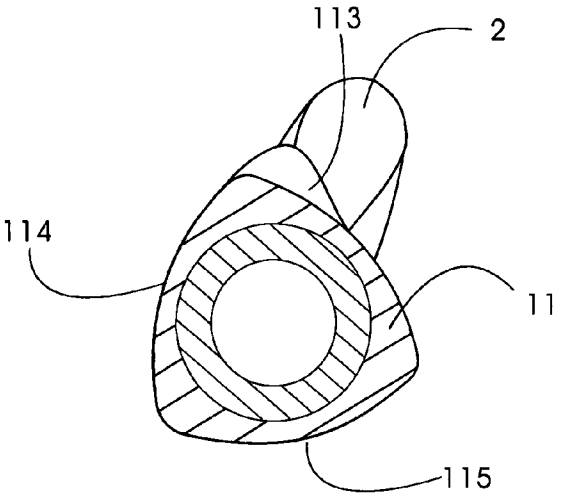
FIG. 4A shows an illustrative view of the flexible action of the holding end in one direction.
Figure 4B:
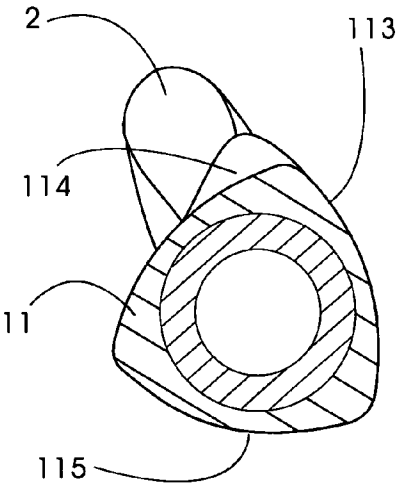
FIG. 4B shows an illustrative view of the flexible action of the holding end in another direction.
Figure 4:
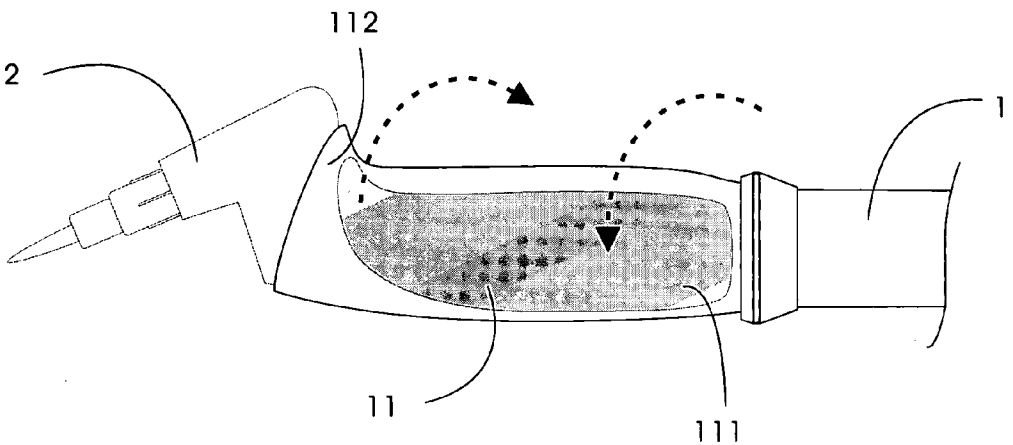
FIG. 4 shows an illustrative view of the flexible action of the holding end according to the present invention.

Please refer to FIGS. 4, 4A and 4B. The holding end 11 is formed of soft materials, such as rubber. Via the plasticity of the holding end 11, the user can optimally adjust the flexibility of the holding end 11 upon operating. As shown in FIG. 4, when one end 111 of the holding end 11 is twisted to one direction, the other end 112 of the holding end 11 would be jammed at Z letter position (as shown in FIGS. 4A and 4B), in which each surface of the holding end 11 would be deflected and result in irregular surfaces 113, 114, 115, so as to create perfect fitting feeling of the fingers. In addition, since the structure can be adjusted into variable geometric holding states (as shown in FIGS. 4A and 4B), different users can get respective comfortable holding poses therefrom, in which their fingers can be naturally directed to the correct holding position.

Figure 5:
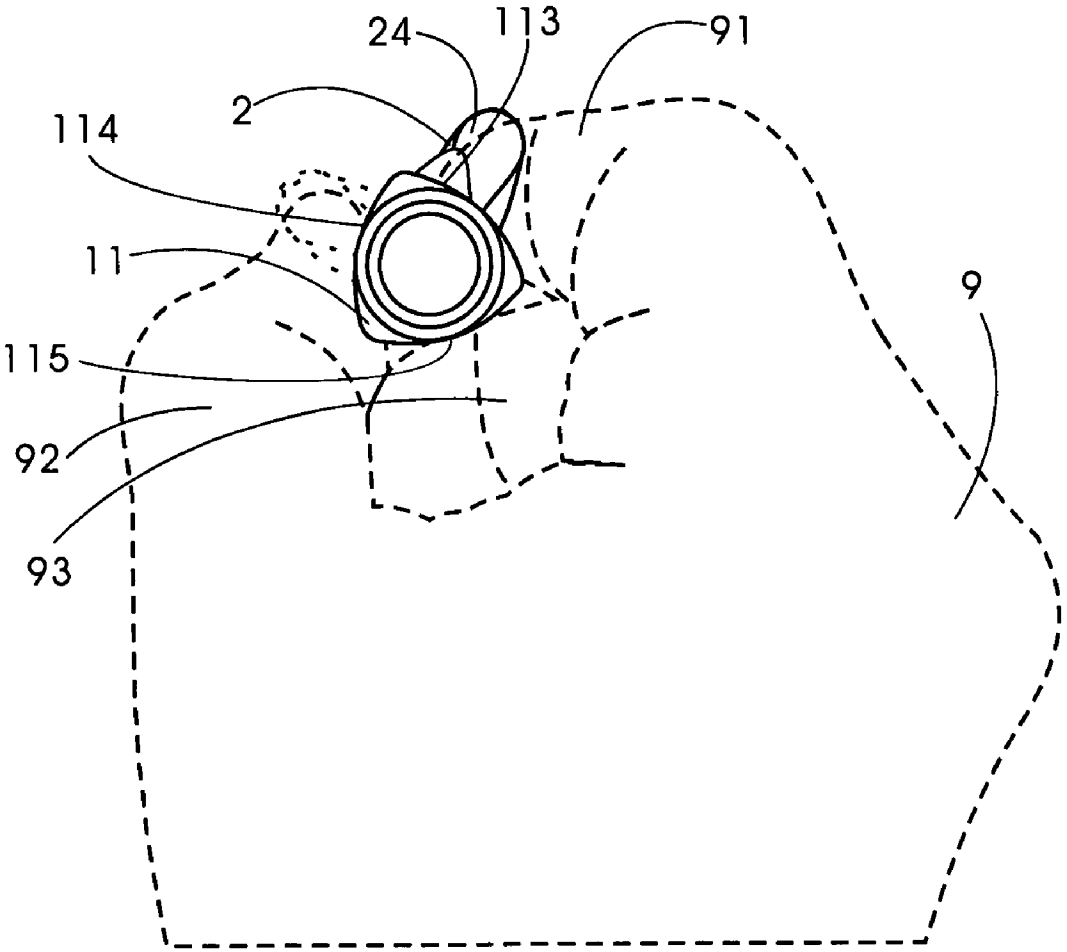
FIG. 5 shows an illustrative view of the holding action in another direction.
Figure 5B:
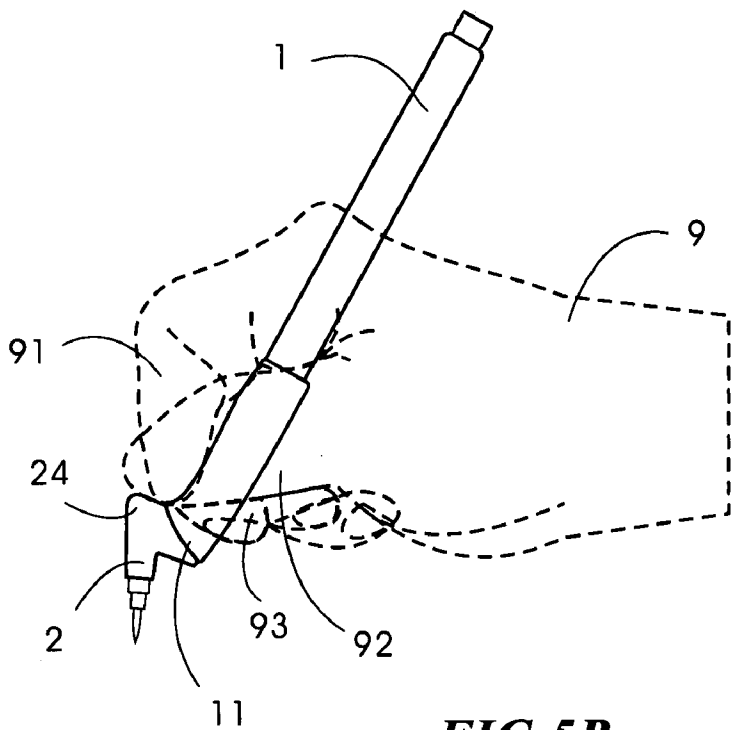
FIG. 5B shows another illustrative side view of the holding action of the fingers.
Figure 5A:
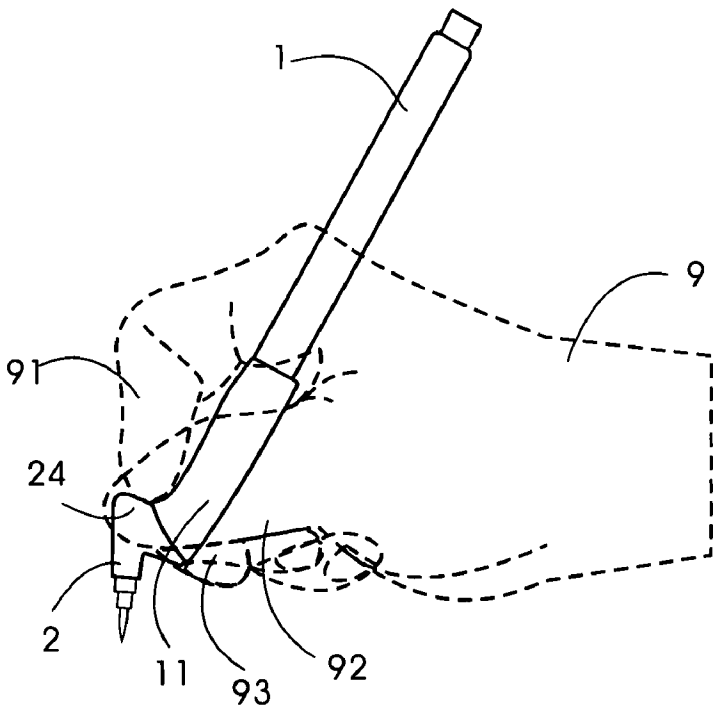
FIG. 5A shows an illustrative side view of the holding action of the fingers.

Please refer to FIGS. 5, 5A, and 5B. A pressing part 24 is disposed at the rear end of the same axis with the writing end 2. When the user holds the writing tool, a single finger 91 (forefinger usually) would be against the end surface of the pressing part 24 for positioning, and other fingers 92, 93 would be naturally directed to attach on the end surfaces at both sides of the holding end 11, so that the user can direct the writing end 2 with his fingers for writing smoothly and operate the writing tool more flexibly and stably. In addition, for adapting different lengths, sizes and thicknesses of the fingers of different hands, when the writing end 2 accompanying with the holding end 11 are provided for the fingers of the user to be against the pressing part 24 for positioning, the thumb 92, forefinger 91 and middle finger 93 can perfectly fit on the surfaces of the holding part 11 and each surface of the holding end 11 would be twisted to form irregular surfaces 113, 114, 115, so as to create perfect fitting feeling of the fingers. Moreover, the pressing part 24 can be provided for the forefinger 91 (as shown in FIG. 5A), as well as the thumb 92 (as shown in FIG. 5B) or other fingers according to the needs of the user, to be against, so as to provide variable selectivity of comfort.

Figure 6:
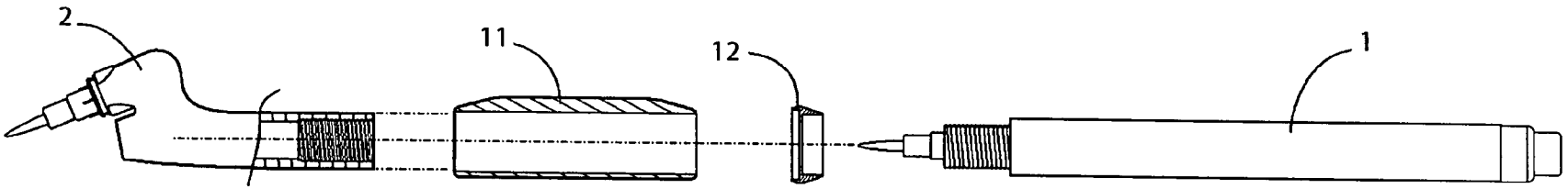
FIG. 6 shows an illustrative view of the disassembly structure of the fixing ring and the writing tool according to the present invention.

Please refer to FIG. 6. If the holding end 11 is externally put around the holding part 1, a fixing ring 12 can be added at the rear end of the holding part 11 to avoid the slip of the holding end 11. In addition, for conforming to the mold design, the holding part 1 and the Z form main body of the writing tool can be manufactured independently, and then fixed together by screwing or inserting.

Figure 7:
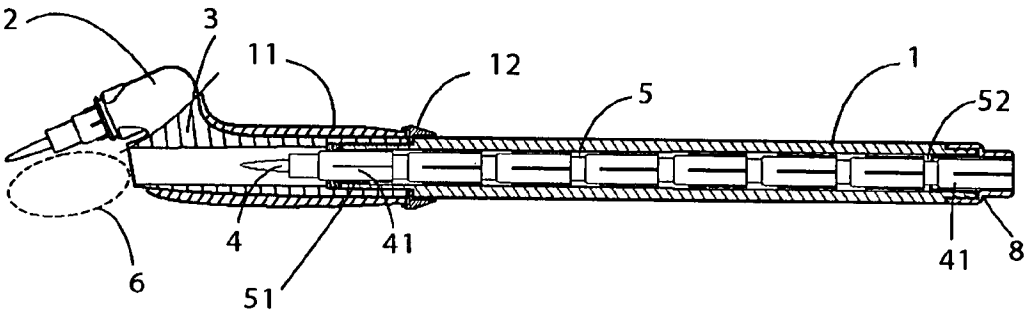
FIG. 7 shows a partial cross-sectional view of the writing tool with the fixing ring according to the present invention.

Please refer to FIG. 7. The holding part 1 includes a receiving space 5, and the writing end 2 is used to contain a markable refill 4 provided for writing. A refill seat 41 is disposed around the refill 4 as a support. A visible space 6 is formed between the writing end 2 and the holding part 1, and the visible space 6 provides an observing region so that the user can monitor the writing condition. The receiving space 5 in the holding part 1 extends through the connecting part 3 and forms openings 51, 52 at two ends for storing a plurality of markable refills 4 used for substituting. In addition, a hollow tail stopper 8 is disposed at the opening 52 of the holding part 1, and the hollow diameter of the hollow tail stopper 8 is smaller than the outer diameter of the refill seat 41, so as to prevent the refill 4 from falling out.

Figure 8:
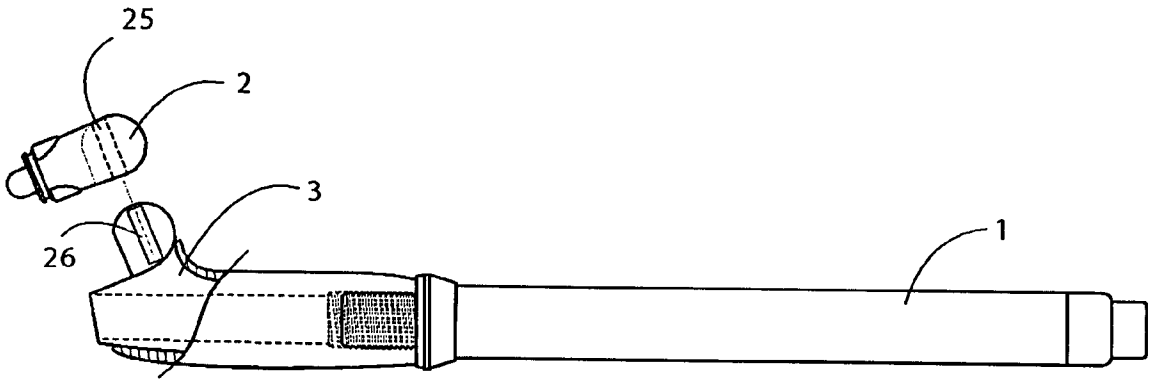
FIG. 8 shows an illustrative view of the disassembly structure of the separate writing end according to the present invention.
Figure 9:
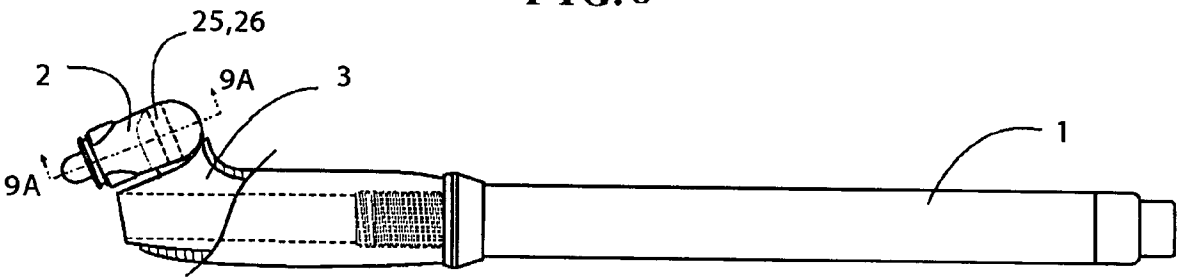
FIG. 9 shows an illustrative view of the assembly structure of the separate writing end according to the present invention.
Figure 10:
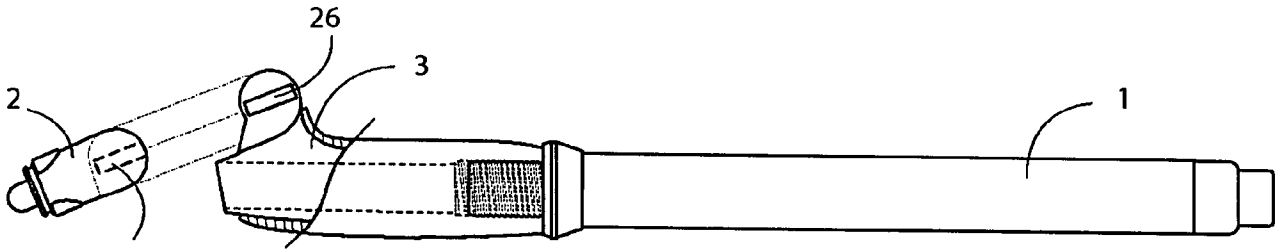
FIG. 10 shows an illustrative view of the separate writing end of another direction according to the present invention.
Figure 9A:
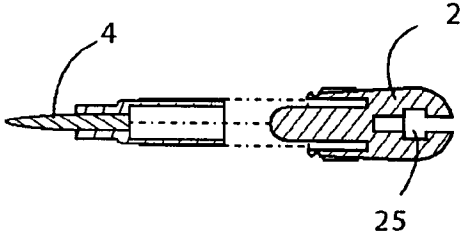
FIG. 9A shows a cross-sectional view of the writing end of FIG. 9.

Please refer to FIGS. 8~10. For conforming to the mold design, the writing end 2, the holding part 1 and the connecting part 3 can be manufactured independently. The rear end of the writing end 2 includes a positioning slot 25, and the connecting part 3 includes a positioning plug 26 correspondingly, so that the positioning slot 25 and the positioning plug 26 can fix with each other by directly fitting or other prior technique.

Figure 11:
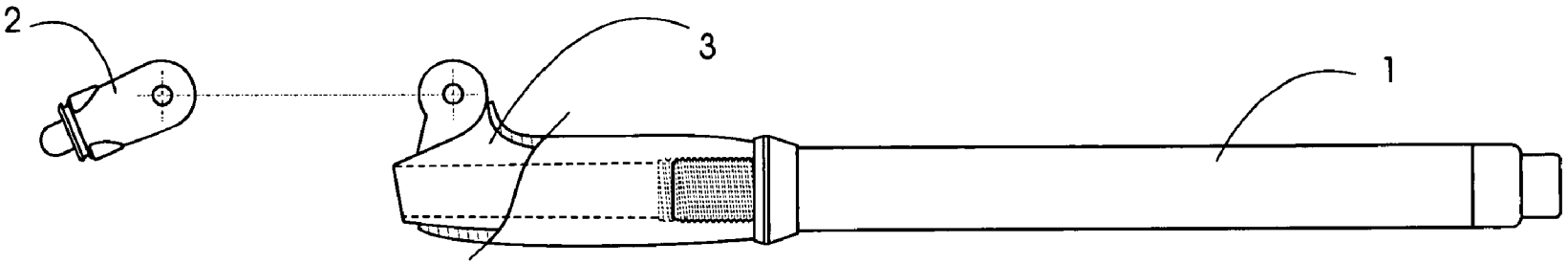
FIG. 11 shows an illustrative view of the disassembly structure of the writing end with a rotating axis design according to the present invention.
Figure 12:
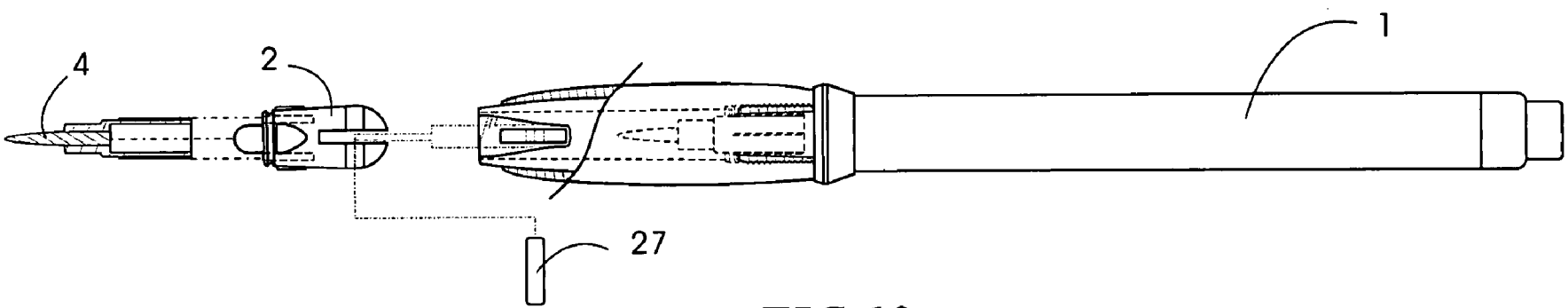
FIG. 12 shows an illustrative view of the disassembly structure of the writing end with a rotating axis design of another direction according to the present invention.
Figure 13:
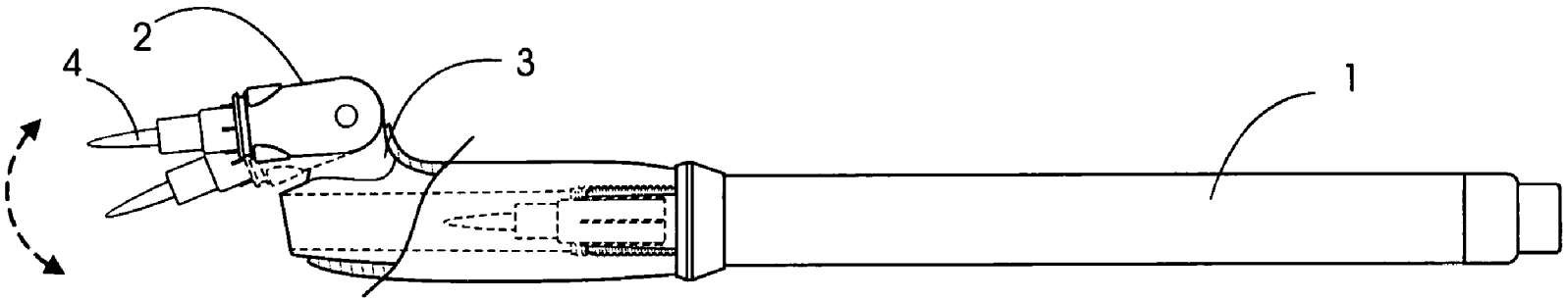
FIG. 13 shows an illustrative view of the assembly structure of the writing end with a rotating axis design according to the present invention.

Please refer to FIGS. 11~13. A rotating axis 27 is disposed between the writing end 2 and the connecting part 3, so that the writing end 2 can be rotated at a different axial angle with respect to the connecting part 3 and adjusted according to the writing pose or habit of the user to achieve the best operating effect.

Figure 14:
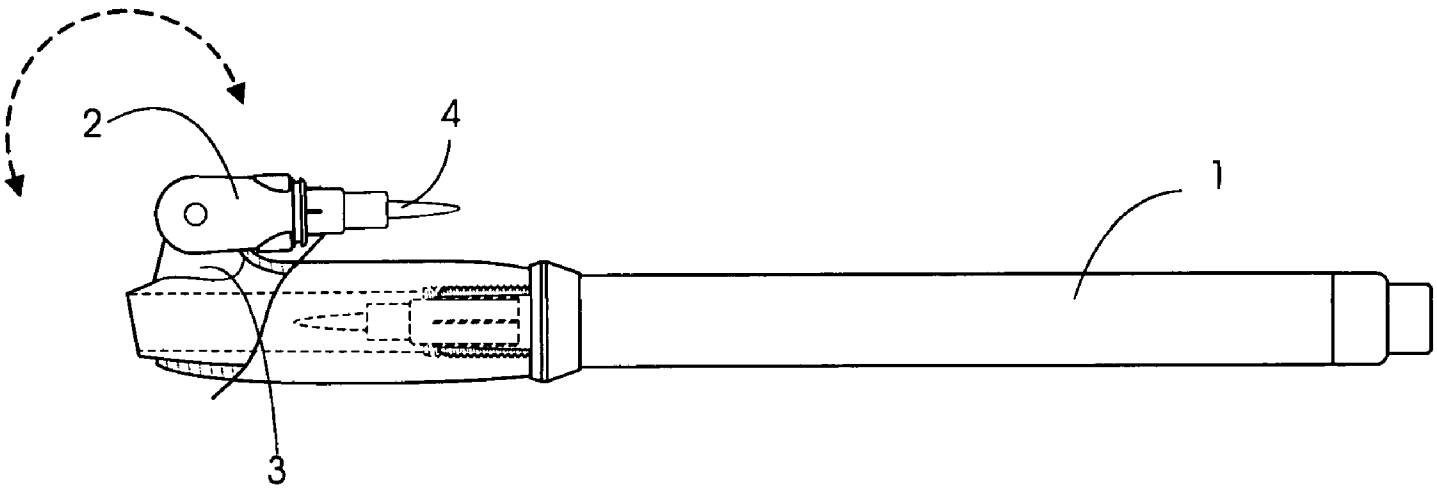
FIG. 14 shows an illustrative view of the action of the writing end with a rotating axis design according to the present invention.

Please refer to FIG. 14. Except to be rotated at a different axial angle with respect to the connecting part 3 and adjusted according to the writing pose or habit of the user, the writing part 2 can also be rotated at a great angle to result in an upward refill, so that the writing tool can be collected in the pocket of the clothes or the collecting box without the need of the cap.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A offset pen, comprising:

a holding part extending in a longitudinal direction to be held and operated by a user;

a writing end including a markable refill provided for writing;

a connecting part connected between a front end of said holding part and a rear end of said writing end, so that said writing end and said holding part are disposed at different axes respectively and a visible space is formed between said writing end and said holding part;

said writing end and said connecting part being pivotally mounted, each with respect to the other about an axis extending normal to said longitudinal direction for selectively adjusting an angle between said writing end and said holding part; and a holding end disposed on said front end of said holding part and being a triangle or other polygon, which is adjustable when held and operated by said user for keeping a correct writing angle.

2. The structure according to claim 1, wherein said holding part, said writing end and said connecting part are substantially arranged as a Z letter.

3. The structure according to claim 1, wherein said holding end is formed independently and then put around said holding part, said holding end is formed of soft materials with plasticity, so that said user can optimally adjust the flexibility of said holding end upon operating to conform to the holding pose of said user.

4. The structure according to claim 1, wherein said writing end is independently formed from said holding part and said connecting part.

5. The structure according to claim 1, wherein said markable refill is selected from a group consisting of a pencil, a colored pencil, a charcoal pencil, a crayon, a chalk, a rubber, a water-based fibers, a water-based animal hairs, a water-based chemical hairs, a water-based plastic compounds, and water-based, oil-based or powder-based solid.

6. The structure according to claim 1, wherein said writing end is an offset pen structure applicable for use with an element selected from the group of a ballpoint pen, a rollerball pen or a pencil.

7. The structure according to claim 1, wherein said holding part includes a receiving space for receiving a plurality of refills, and said receiving space extends to said connecting part for storing said refills for substitution of one refill for another.

8. The structure according to claim 7, wherein one or both ends of said receiving space have openings for storing said refills for substitution of one refill for another.

9. The structure according to claim 1, wherein a pressing part is disposed at the rear end of the same axis with said writing end, and when said user holds said writing tool, the forefinger is against said pressing part, and other fingers are naturally directed on other end surfaces.

* * * * *